US011647804B2

(12) United States Patent
Shaffer et al.

(10) Patent No.: US 11,647,804 B2
(45) **Date of Patent: *May 16, 2023**

(54) PROTECTIVE HELMET WITH INTEGRATED ROTATIONAL LIMITER

(71) Applicant: Bell Sports, Inc., Scotts Valley, CA (US)

(72) Inventors: Samuel J. Shaffer, Santa Cruz, CA (US); Mark A. Busse, Santa Cruz, CA (US); Rafael T. Ramirez, Santa Clara, CA (US); Eamon Briggs, Santa Cruz, CA (US)

(73) Assignee: Bell Sports, Inc., Scotts Valley, CA (US)

( * ) Notice: Subject to any disclaimer, the term of this patent is extended or adjusted under 35 U.S.C. 154(b) by 45 days.

This patent is subject to a terminal disclaimer.

(21) Appl. No.: 17/064,159

(22) Filed: Oct. 6, 2020

(65) Prior Publication Data

US 2021/0030100 A1 Feb. 4, 2021

Related U.S. Application Data

(63) Continuation of application No. 15/990,567, filed on May 25, 2018, now Pat. No. 10,834,988, which is a continuation of application No. 15/638,257, filed on Jun. 29, 2017, now Pat. No. 10,010,126.

(51) Int. Cl.

| | |
|---|---|
| ***A42B 3/06*** | (2006.01) |
| ***A42B 3/28*** | (2006.01) |
| ***A42B 3/12*** | (2006.01) |

(52) U.S. Cl.
CPC ..... *A42B 3/064* (2013.01); *A42B 3/12* (2013.01); *A42B 3/283* (2013.01)

(58) Field of Classification Search
None
See application file for complete search history.

(56) References Cited

U.S. PATENT DOCUMENTS

| | | | | | |
|---|---|---|---|---|---|
| 1,244,559 | A | * | 10/1917 | Stocks | A42B 3/064 2/416 |
| 3,495,272 | A | * | 2/1970 | Tempelhof | A42B 3/324 2/420 |
| 4,345,338 | A | * | 8/1982 | Frieder, Jr. | A42B 3/124 2/425 |
| 5,010,598 | A | * | 4/1991 | Flynn | A42B 3/281 2/909 |

(Continued)

*Primary Examiner* — Bao-Thieu L Nguyen
(74) *Attorney, Agent, or Firm* — Walter M. Egbert, III; Richard J. Brown; Reed Smith LLP

(57) ABSTRACT

A helmet is disclosed for protection during an impact. An inner liner may slidably couple to the outer liner through at least one return spring. The outer liner includes an interior surface with a shelf extending inward. The shelf includes an arresting surface. The inner liner has an exterior surface, an interior surface and an edge connecting the exterior surface to the interior surface. The edge faces the arresting surface of the shelf. The inner liner is slidably movable relative to the outer liner between a first position in which the edge of the inner liner is separated from the arresting surface of the shelf by a first gap, and an arrested position in which a portion of the edge of the inner liner is in contact with a portion of the arresting surface of the shelf.

11 Claims, 7 Drawing Sheets

(56) References Cited

U.S. PATENT DOCUMENTS 5,742,937 A * 4/1998 Baudou ..... G02B 27/0176 2/6.3
5,940,889 A * 8/1999 Shirai ..... A42B 3/283 2/171.3
6,925,657 B2 * 8/2005 Takahashi ..... A42B 3/128 2/412
8,578,520 B2 * 11/2013 Halldin ..... A42B 3/14 2/412
8,683,617 B2 * 4/2014 Chilson ..... A42B 3/32 2/171.1
8,782,819 B1 * 7/2014 Culpepper ..... A42B 3/10 2/410
8,955,169 B2 * 2/2015 Weber ..... A42B 3/125 2/425
9,131,743 B2 * 9/2015 Marzec ..... A42B 3/12
9,474,316 B2 * 10/2016 Berry ..... A42B 3/064
9,549,582 B2 * 1/2017 Phipps ..... B60R 19/18
10,010,126 B1 * 7/2018 Shaffer ..... A42B 3/283
10,561,192 B2 2/2020 Weber et al.
10,834,988 B2 * 11/2020 Shaffer ..... A42B 3/064
2001/0032351 A1 * 10/2001 Nakayama ..... A42B 3/064 2/412
2003/0140400 A1 * 7/2003 Ho ..... A42B 3/063 2/412
2004/0250340 A1 * 12/2004 Piper ..... A42B 3/064 2/412
2006/0162053 A1 * 7/2006 Lee ..... B29C 70/78 156/242
2010/0319110 A1 * 12/2010 Preston-Powers ..... A42B 3/285 2/422
2012/0000008 A1 * 1/2012 Baldackin ..... A42B 3/124 2/410
2012/0060251 A1 * 3/2012 Schimpf ..... A42B 3/064 2/5
2012/0198604 A1 * 8/2012 Weber ..... A42B 3/064 2/410
2014/0007322 A1 * 1/2014 Marz ..... A42B 3/065 428/156
2014/0013491 A1 * 1/2014 Hoshizaki ..... A42B 3/12 2/411
2014/0223641 A1 * 8/2014 Henderson ..... A42B 3/065 2/411
2015/0089724 A1 * 4/2015 Berry ..... A42B 3/064 2/414
2015/0089725 A1 * 4/2015 Lowe ..... A42B 3/125 2/410
2015/0250246 A1 * 9/2015 Phipps ..... A42B 3/285 293/137
2015/0250253 A1 * 9/2015 Jacobsen ..... A42B 3/221 2/411
2015/0264991 A1 * 9/2015 Frey ..... A42B 3/064 2/411
2015/0359285 A1 * 12/2015 Rennaker, II ..... A42B 3/20 2/414
2016/0161222 A1 * 6/2016 Lee ..... A42B 3/064 2/416
2020/0305534 A1 * 10/2020 Chilson ..... B32B 3/04

* cited by examiner

PROTECTIVE HELMET WITH INTEGRATED ROTATIONAL LIMITER

RELATED APPLICATIONS

This application is a continuation of U.S. patent application Ser. No. 15/990,567, filed on May 25, 2018, which is a continuation of U.S. patent application Ser. No. 15/638,121, filed on Jun. 29, 2017, the disclosures of which are incorporated by reference in its entirety herein.

TECHNICAL FIELD

Aspects of this document relate generally to helmets with an integrated rotational limiter.

BACKGROUND

Protective headgear and helmets have been used in a wide variety of applications and across a number of industries including sports, athletics, construction, mining, military defense, and others, to prevent damage to a user's head and brain. Contact injury to a user can be prevented or reduced by helmets that prevent hard objects or sharp objects from directly contacting the user's head. Non-contact injuries, such as brain injuries caused by linear or rotational accelerations of a user's head, can also be prevented or reduced by helmets that absorb, distribute, or otherwise manage energy of an impact. This may be accomplished using multiple layers of energy management material.

Conventional helmets having multiple energy management liners are able to reduce the rotational energy transferred to the head and brain by facilitating and controlling the rotation of the energy management liners against one another. Some conventional helmets, such as, for example, those disclosed in US Published application 20120060251 to Schimpf (hereinafter "Schimpf") employ a continuous surface interrupted by a recess in the outer liner that a projection from the inner liner extends into. Additionally, other conventional helmets, such as those disclosed in US Published application 20010032351 to Nakayama (hereinafter "Nakayama") employ an inner liner and an outer liner that both have interlocking recesses and projections.

Some conventional helmets employ structures or objects that bridge energy liners that must break, deform, and/or deform an elastic material for the liners to rotate against each other. Such a method of energy absorption has advantages and disadvantages; while the energy is absorbed by the failure or deformation of the projections, it either happens over a short period of time, thus doing little to attenuate the rotational accelerations experienced by the user's head and brain, or the liners may tend to rotate out of one another, reducing the helmet stability.

SUMMARY

According to one aspect, a helmet includes an outer liner having an interior surface comprising a shelf extending inward from the interior surface proximate a perimeter of an opening at a lower edge of the outer liner. The shelf includes an arresting surface. The helmet also includes an inner liner having an exterior surface, an interior surface and an edge connecting the exterior surface to the interior surface. The edge is facing the arresting surface of the shelf. The inner liner is slidably coupled to the interior surface of the outer liner through at least one return spring and slidably movable relative to the outer liner between a first position in which the edge of the inner liner is separated from the arresting surface of the shelf by a first gap, and an arrested position in which a portion of the edge of the inner liner is in contact with a portion of the arresting surface of the shelf in response to movement of the outer liner relative to the inner liner caused by an impact to the helmet. Furthermore, the at least one return spring biases the inner liner toward the first position.

Particular embodiments may comprise one or more of the following features: the interior surface proximate a majority of the perimeter of the opening may include the shelf. The at least one return spring may be composed of an elastomer material. The first gap separating the edge of the inner liner from the arresting surface of the shelf while the inner liner is in the centered position may be between 12 mm and 15 mm. The shelf may include a plurality of shelf pieces. The arresting surface of the shelf may be discontinuous. The outer liner may include a front, a rear, and/or two sides opposite each other and connecting the front and the rear, Also, a first portion of the shelf may be located proximate the rear of the outer liner, a second portion of the shelf may be located proximate one of the two sides of the outer liner, and a third portion of the shelf may be located proximate the other of the two sides of the outer liner. The first gap may be substantially uniform across the arresting surface when the inner liner is in the first position. The outer liner may include a plurality of vents passing through the outer liner. The inner liner may include a plurality of channels passing through the inner liner. The plurality of channels may at least partially overlap with the plurality of vents, and may form a plurality of apertures from outside the helmet to inside the helmet. Each of the plurality of vents may be beveled at the interior surface of the outer liner. Each of the plurality of channels may be beveled at the exterior surface of the inner liner. Additionally, at least one of the interior surface of the outer liner and the exterior surface of the inner liner may include a surface of reduced friction. Finally, an air gap may exist between a majority of the exterior surface of the inner liner and the interior surface of the outer liner.

According to another aspect, a helmet includes an outer liner having an interior surface including a shelf extending inward from the interior surface proximate a majority of a perimeter of an opening at a lower edge of the outer liner. The shelf includes an arresting surface. The helmet also includes an inner liner having an exterior surface, an interior surface and an edge connecting the exterior surface to the interior surface. The edge is facing the arresting surface of the shelf. The inner liner is slidably coupled to the interior surface of the outer liner through at least one return spring. Also, the inner liner is slidably movable relative to the outer liner between a first position in which the edge of the inner liner is separated from the arresting surface of the shelf by a first gap that is substantially uniform across the arresting surface, and an arrested position in which a portion of the edge of the inner liner is in contact with a portion of the arresting surface of the shelf in response to movement of the outer liner relative to the inner liner caused by an impact to the helmet. Lastly, the at least one return spring biases the inner liner toward the first position.

Aspects and applications of the disclosure presented here are described below in the drawings and detailed description. Unless specifically noted, it is intended that the words and phrases in the specification and the claims be given their plain, ordinary, and accustomed meaning to those of ordinary skill in the applicable arts. The inventors are fully aware that they can be their own lexicographers if desired. The inventors expressly elect, as their own lexicographers, to use only the plain and ordinary meaning of terms in the specification and claims unless they clearly state otherwise and then further, expressly set forth the "special" definition of that term and explain how it differs from the plain and ordinary meaning. Absent such clear statements of intent to apply a "special" definition, it is the inventors' intent and desire that the simple, plain and ordinary meaning to the terms be applied to the interpretation of the specification and claims.

The inventors are also aware of the normal precepts of English grammar. Thus, if a noun, term, or phrase is intended to be further characterized, specified, or narrowed in some way, then such noun, term, or phrase will expressly include additional adjectives, descriptive terms, or other modifiers in accordance with the normal precepts of English grammar. Absent the use of such adjectives, descriptive terms, or modifiers, it is the intent that such nouns, terms, or phrases be given their plain, and ordinary English meaning to those skilled in the applicable arts as set forth above.

Further, the inventors are fully informed of the standards and application of the special provisions of 35 U.S.C. § 112, ¶ 6. Thus, the use of the words "function," "means" or "step" in the Detailed Description or Description of the Drawings or claims is not intended to somehow indicate a desire to invoke the special provisions of 35 U.S.C. § 112, ¶ 6, to define the invention. To the contrary, if the provisions of 35 U.S.C. § 112, ¶ 6 are sought to be invoked to define the inventions, the claims will specifically and expressly state the exact phrases "means for" or "step for", and will also recite the word "function" (i.e., will state "means for performing the function of [insert function]"), without also reciting in such phrases any structure, material or act in support of the function. Thus, even when the claims recite a "means for performing the function of . . . " or "step for performing the function of . . . ," if the claims also recite any structure, material or acts in support of that means or step, or that perform the recited function, then it is the clear intention of the inventors not to invoke the provisions of 35 U.S.C. § 112, ¶ 6. Moreover, even if the provisions of 35 U.S.C. § 112, ¶ 6 are invoked to define the claimed aspects, it is intended that these aspects not be limited only to the specific structure, material or acts that are described in the preferred embodiments, but in addition, include any and all structures, materials or acts that perform the claimed function as described in alternative embodiments or forms of the disclosure, or that are well known present or later-developed, equivalent structures, material or acts for performing the claimed function.

The foregoing and other aspects, features, and advantages will be apparent to those artisans of ordinary skill in the art from the DESCRIPTION and DRAWINGS, and from the CLAIMS.

BRIEF DESCRIPTION OF THE DRAWINGS

The inventions will hereinafter be described in conjunction with the appended drawings, where like designations denote like elements, and.

DETAILED DESCRIPTION

Figure 1A:
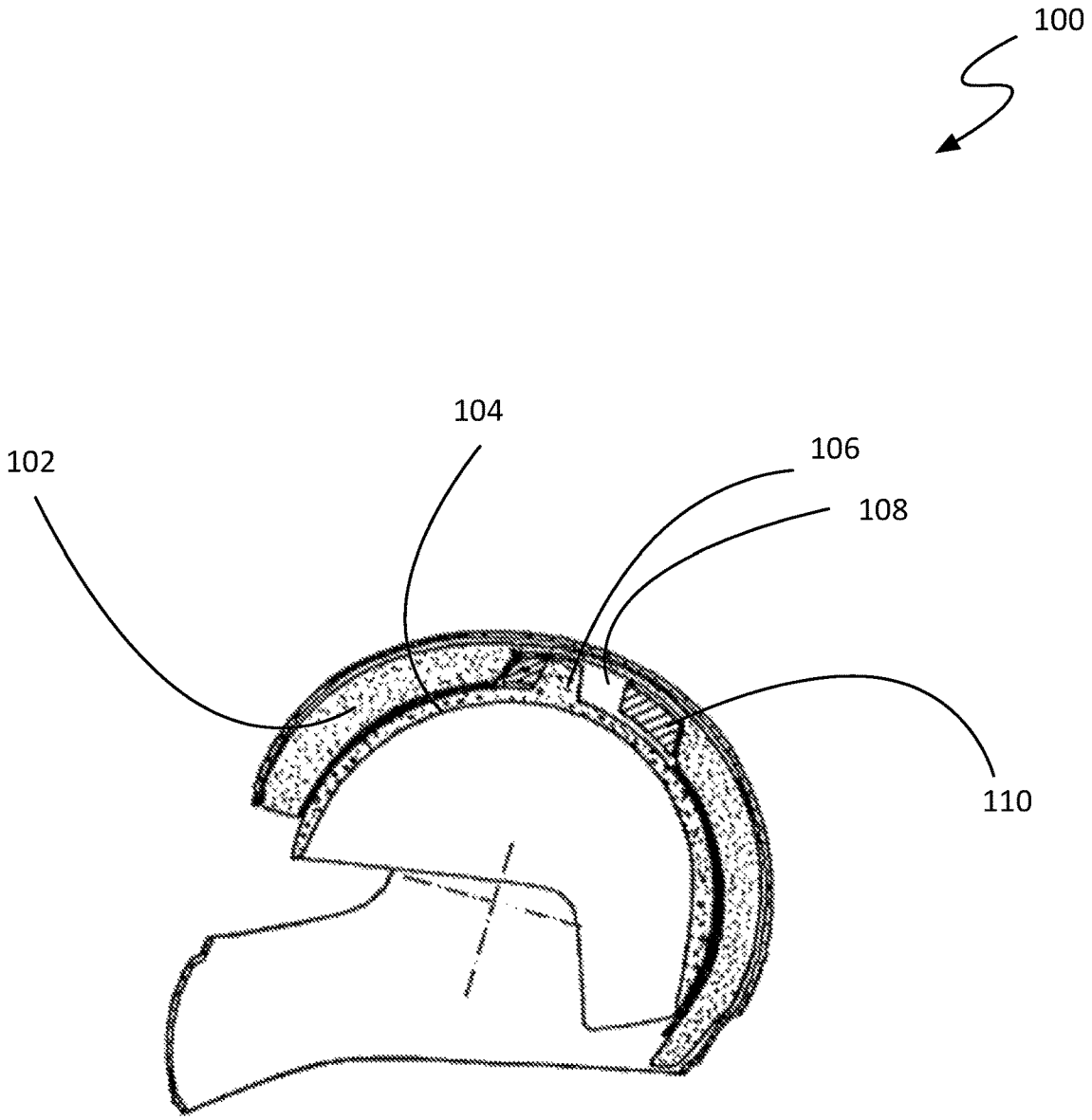
FIG. 1A (Prior Art)
FIGS. 1A and 1B show embodiments of a helmet with multiple energy management liners as known prior art.

This disclosure, its aspects and implementations, are not limited to the specific material types, components, methods, or other examples disclosed herein. Many additional material types, components, methods, and procedures known in the art are contemplated for use with particular implementations from this disclosure. Accordingly, for example, although particular implementations are disclosed, such implementations and implementing components may comprise any components, models, types, materials, versions, quantities, and/or the like as is known in the art for such systems and implementing components, consistent with the intended operation.

The word "exemplary," "example," or various forms thereof are used herein to mean serving as an example, instance, or illustration. Any aspect or design described herein as "exemplary" or as an "example" is not necessarily to be construed as preferred or advantageous over other aspects or designs. Furthermore, examples are provided solely for purposes of clarity and understanding and are not meant to limit or restrict the disclosed subject matter or relevant portions of this disclosure in any manner. It is to be appreciated that a myriad of additional or alternate examples of varying scope could have been presented, but have been omitted for purposes of brevity.

While this disclosure includes a number of embodiments in many different forms, there is shown in the drawings and will herein be described in detail particular embodiments with the understanding that the present disclosure is to be considered as an exemplification of the principles of the disclosed methods and systems, and is not intended to limit the broad aspect of the disclosed concepts to the embodiments illustrated.

Conventional helmets having multiple energy management liners reduce the rotational energy of an impact transferred to the head and brain by facilitating and controlling the rotation of the energy management liners against one another. Some conventional helmets employ liner interfaces interrupted by a recess in one liner that a projection from another liner extends into, limiting the ability of one liner to rotate with respect to the other. See, for example, FIG. 1A, which shows a helmet 100 with a continuous outer liner 102 having a recess 108 with dampening material 110 and a continuous inner liner 104 having a projection 106 extending into the recess 108, similar to the helmet shown in FIG. 15 of the prior art reference to Schimpf referenced previously herein. Upon impact, rotational energy is absorbed as the outer liner 102 moves with respect to the inner liner 104 and the projection 106 compresses the dampening material 110. See also FIG. 1B, which shows a helmet 150 with a continuous outer liner 152 and a continuous inner liner 154, each having a series of interlocking recesses 158 and projections 156 separated by elastic material 160, similar to the helmet shown in FIG. 6 of the prior art reference to Nakayama referenced previously herein.

Conventional helmets employing structures such as these have the disadvantage of relying on one or more small projections, and friction between liners, to absorb all of the rotational energy of an impact. The absorption is either done over a small period of time, thus doing little to attenuate the rotational accelerations/decelerations experienced by the user's head and brain, or is spread over a range of relative displacement of the liners that stability is compromised, and one liner will possibly rotate out of another, compromising the head protection for the wearer.

Additionally, some conventional helmets include a continuous interface surface between an inner liner and the outer liner. See, for example, the continuous outer liner 102 and a continuous inner liner 104 of the helmet 100 of FIG. 1A, and the continuous outer liner 152 and a continuous inner liner 154 of the helmet 150 of FIG. 1B. Such a design allows for the rotational energies to be absorbed by more material, whether through protrusions extending into recesses, or deformable structures bridging liners. However, conventional helmet designs configured in this way are conventionally manufactured for football or motorcycle helmets, and are not suitable for implementations where ventilation is a concern, such as conventional bicycle helmets where a large portion of the helmet is required to have air flow openings and gaps extending from the innermost area of the helmet through all energy management liners. Relying entirely upon interlocking protrusions and recesses, or deformable bridging structures, may constrain the size of the airflow openings, lest the liner not be able to withstand the forces exerted by the projections and/or deformable bridges.

Contemplated as part of this disclosure are helmets having multiple energy management liners that are able to effectively rotate against one another upon impact while still being limited in the range of rotation by an integrated rotational limiter. Specifically, by using a rotational limiter, such as a shelf or a series of partial shelves or shelf pieces, on an interior surface of an outer liner to interface with an edge of an inner liner, a protective helmet may effectively attenuate rotational energy of an impact while also retaining and stabilizing the inner liner inside the outer liner.

FIGS. 2-5 illustrate a non-limiting embodiment of a helmet 200 comprising an outer liner 202 and an inner liner 204. The interior surface 300 of the outer liner 202 comprises a shelf 400 (FIGS. 4A-5) with an arresting surface 402, and the inner liner 204 comprises an edge 306 facing the arresting surface 402 of the shelf 400. The inner liner 204 is slidably coupled to the interior surface 300 of the outer liner 202 through a series of return springs 500. Upon impact, rotational energy is initially absorbed by the outer liner 202 sliding with respect to the inner liner 204, as well as by the deformation of the return springs 500 as the outer liner 202 moves away from a resting position (see first position 414 of FIG. 4A). If the rotational energy of the impact is sufficient to slide the outer liner 202 with respect to the inner liner 204 far enough that the edge 306 of the inner liner 204 is in contact with the arresting surface 402 of the shelf 400, additional energy is absorbed by the energy management materials of the inner and outer liners.

Figure 1B:
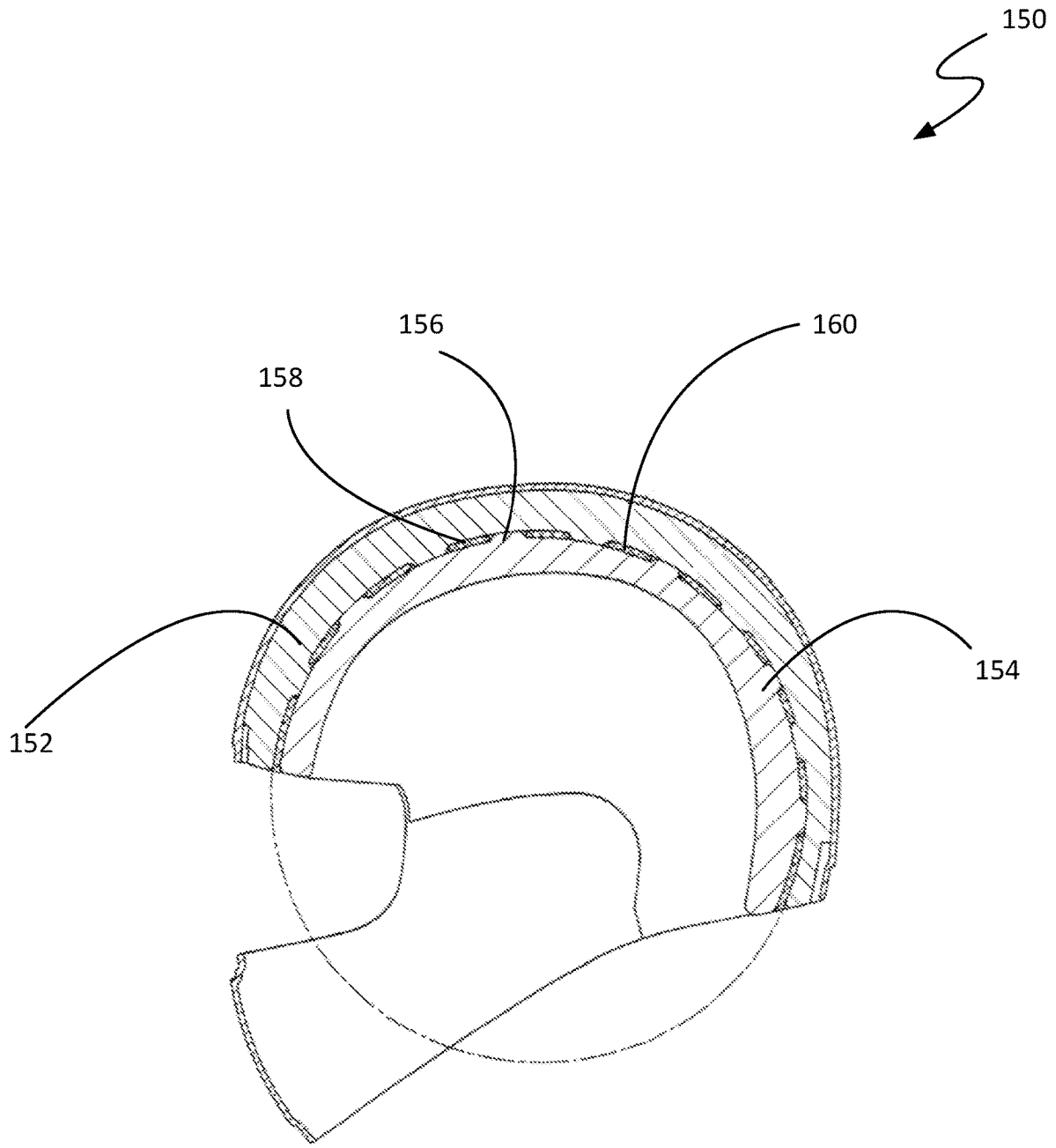
FIG. 1B (Prior Art)

This is advantageous in relation to conventional helmets, such as helmet 100 of FIG. 1A and helmet 150 of FIG. 1B, which absorb rotational energy through small projections bridging energy management liners. In contrast to the sharp decelerations and sharply localized energy absorption associated with conventional helmets, the contact between the edge 306 and the shelf 400 absorbs the rotational energy across a wider, stronger portion of the liner over a longer time than a small projection compressing a small amount of elastic material, and prevents the inner liner 204 from rotating out of the outer liner 202. This results in better attenuation of the rotational acceleration/deceleration of the user's head and brain while stabilizing the helmet and reducing the chance of liner separation.

Figure 3:
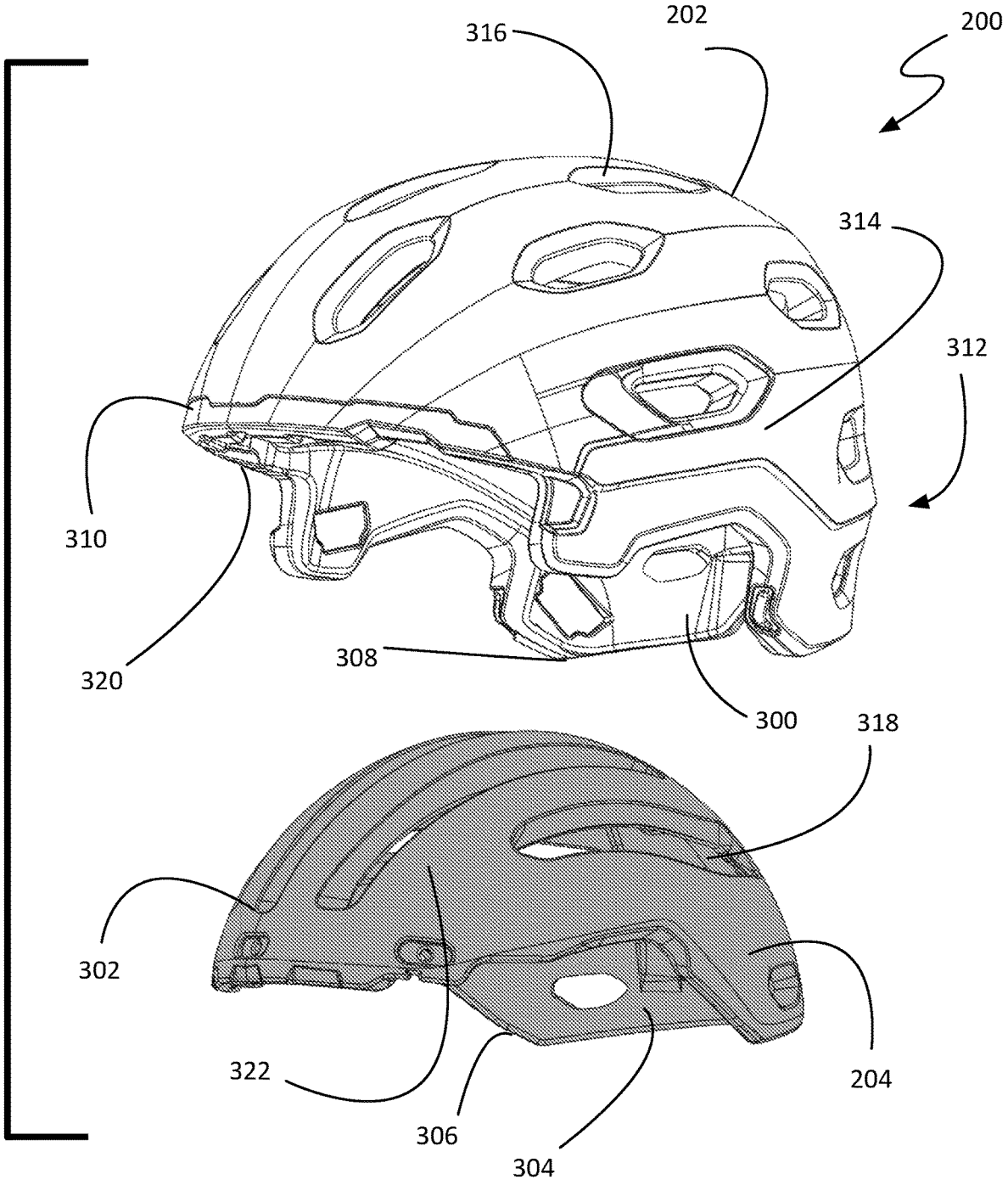
FIG. 3 is an exploded view of the helmet of FIG. 2.

FIG. 3 shows an exploded view of a non-limiting example of a helmet 200. As shown, helmet 200 has an outer liner 202 and an inner liner 204. The inner liner 204 may be slidably coupled to the interior surface 300 of the outer liner 202, according to various embodiments. In other embodiments, additional liners may be included.

Reference is made herein to inner and/or outer liners comprising an energy management material. As used herein, the energy management material may comprise any energy management material known in the art of protective helmets, such as but not limited to expanded polystyrene (EPS), expanded polyurethane (EPU), expanded polyolefin (EPO), expanded polypropylene (EPP), or other suitable material.

An outer liner 202 is exterior to the inner layer of a helmet and is composed, at least in part, of energy management materials. In some embodiments, the exterior surface of the outer liner 202 may comprise an additional outer shell layer, such as a layer of stamped polyethylene terephthalate (PET) or a polycarbonate (PC) shell, to increase strength and rigidity. This shell layer may be bonded directly to the energy management material of the outer liner 202. In some embodiments, the outer liner 202 may have more than one rigid shell. For example, in one embodiment, the outer liner 202 may have an upper PC shell and a lower PC shell.

According to various embodiments, the outer liner 202 may be the primary load-carrying component for high-energy impacts. As such, the outer liner 202 may be composed of a high-density energy management material. As a specific example, the outer liner may be composed of EPS.

The outer liner 202 may provide a rigid skeleton for the helmet 200, and as such may serve as the attachment point for accessories, such as a chin bar, or other structures. Although not shown in FIG. 2, the helmets of this disclosure may comprise any other features of protective helmets previously known in the art, such as but not limited to straps, comfort liners, masks, visors, and the like. For example, in one embodiment, the inner liner 204 may include a fit system to provide improved comfort and fit.

As shown, the outer liner 202 has an opening 206 at the lower edge 308, where a user would insert their head. The perimeter 320 of the opening 206 of the outer liner 202 is bordered by a front 310, a rear 312, as well as two sides 314 opposite each other and connecting the front 310 and the rear 312. In some embodiments, the outer liner 202 may comprise one or more vents 316 passing between the outside of the liner to the inside. In other embodiments, the outer liner 202 may be continuous and unvented. As previously discussed, the outer liner 202 also has an interior surface 300 comprising a shelf 400 extending inward proximate the perimeter 320 of the opening 206. The shelf 400 will be discussed in greater detail with respect to FIGS. 4A and 4B.

Figure 2:
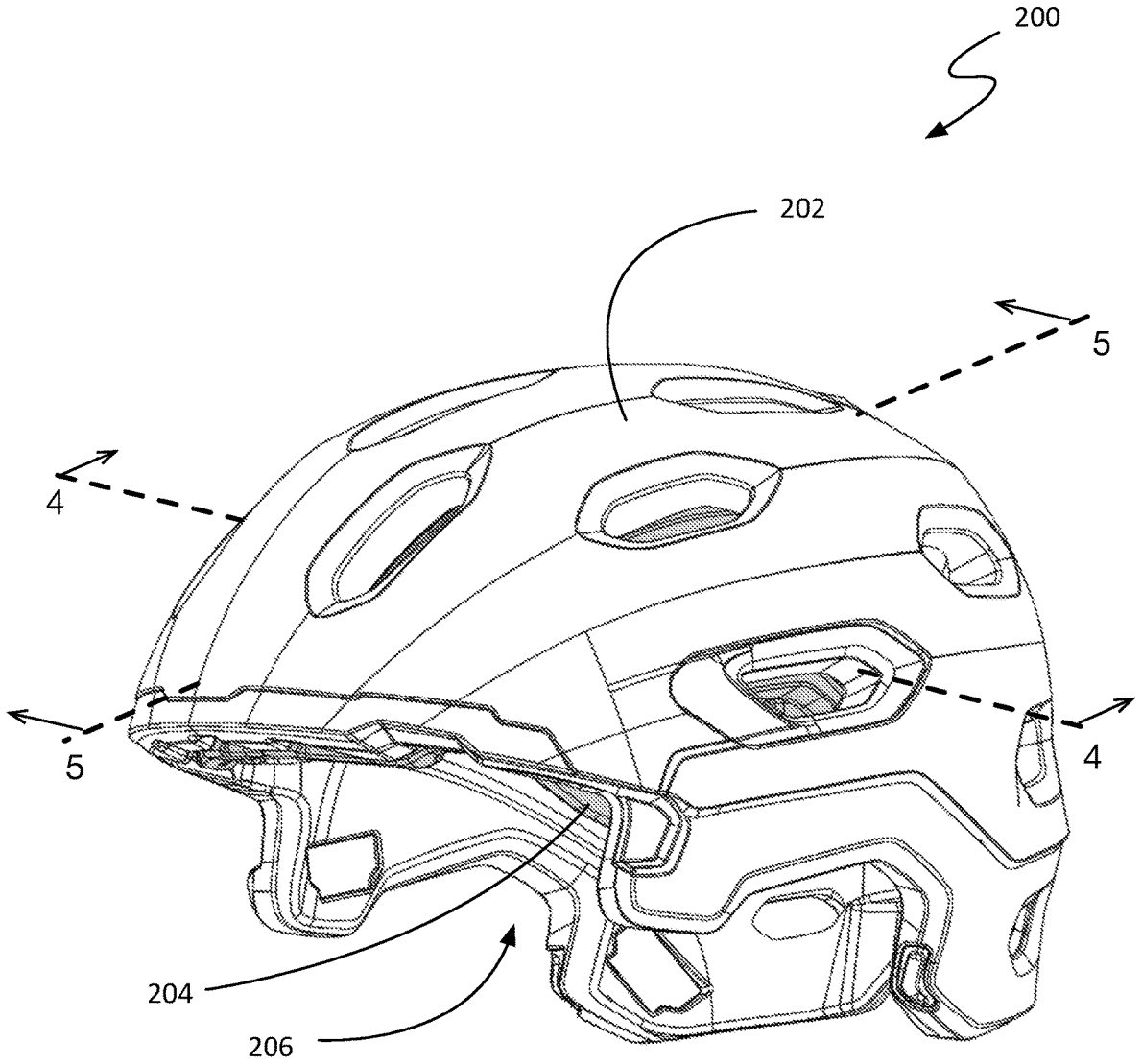
FIG. 2 is a perspective view of a helmet.

Also shown in FIGS. 2 and 3 is a non-limiting example of an inner liner 204. An inner liner 204 refers to an energy management liner of a helmet that is, at least in part, inside of another liner, such as outer liner 202 or another inner liner. The inner liner 204 is composed, at least in part, of an energy-management material.

The inner liner 204 has an exterior surface 302 and an interior surface 304. The perimeters of these surfaces are connected by an edge 306. The edge 306 might also be referred to as an edge surface, or an edge face. In some embodiments, the edge 306 may interface with the exterior surface 302 and the interior surface 304 at an angle. In other embodiments, the edge 306 may smoothly blend into the exterior surface 302 and the interior surface 304. In some embodiments, the edge 306 may be a flat surface, while in others, it may be a curved, wavy, or multi-faceted surface. Furthermore, in some embodiments, the inner liner 204 may comprise one or more channels 318 passing between the exterior surface 302 and the interior surface 304 to facilitate ventilation. In other embodiments, the inner liner 204 may be continuous and unvented.

Figure 4A:
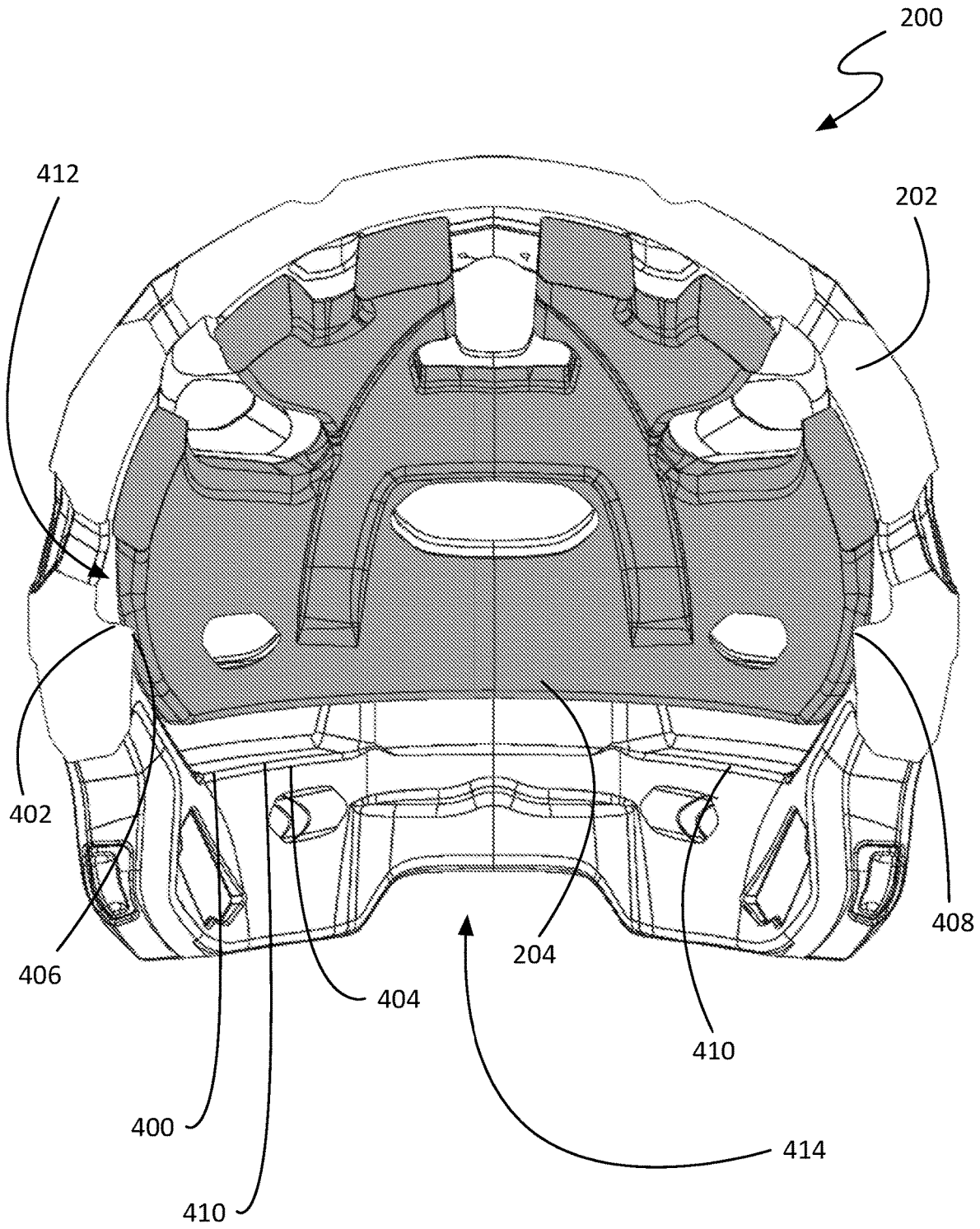
FIG. 4A is a front cross-sectional view of the helmet of FIG. 2 in a first position taken along cross-section lines A-A.
Figure 4B:
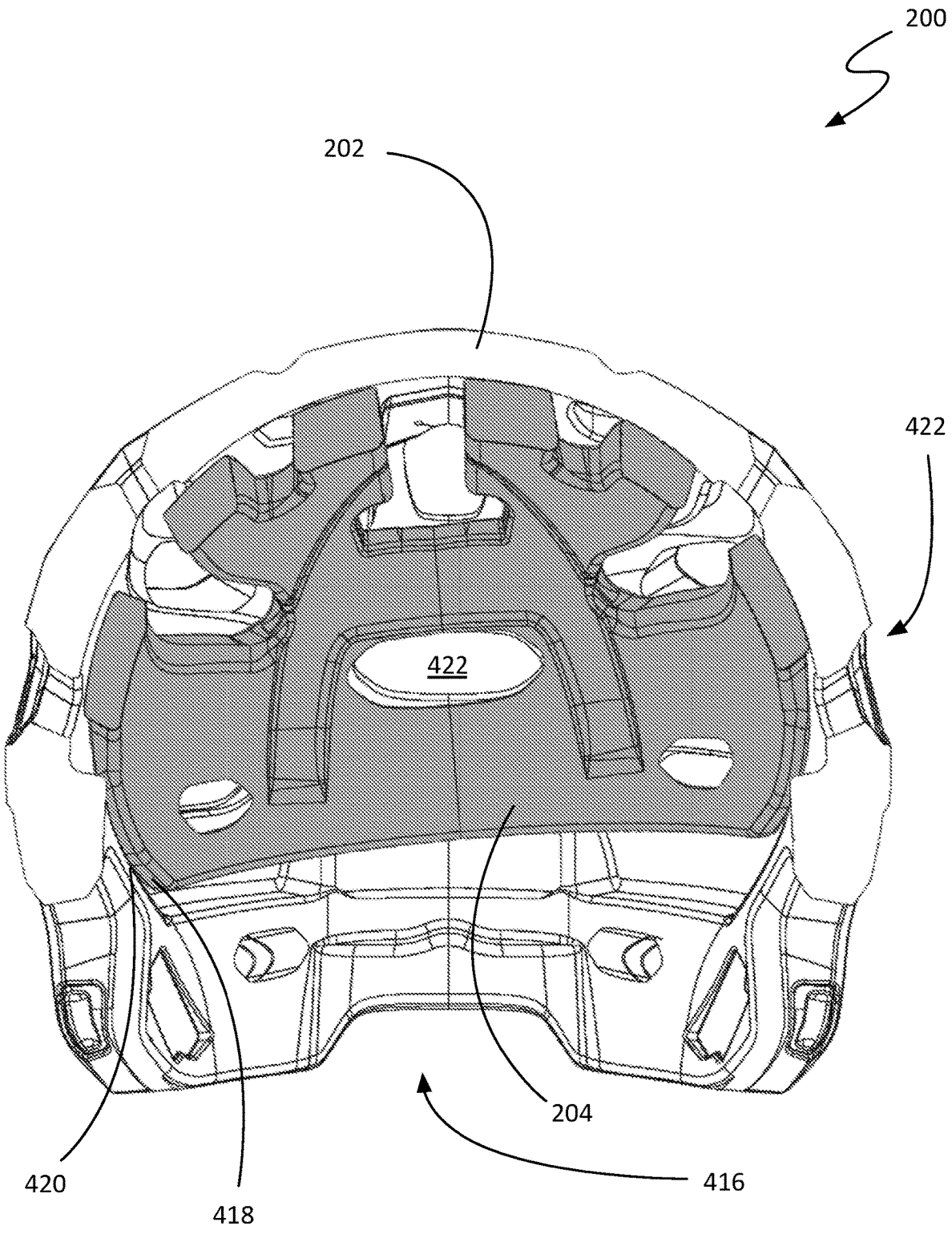
FIG. 4B is a view of the helmet of FIG. 4A in an arrested position.
Figure 5:
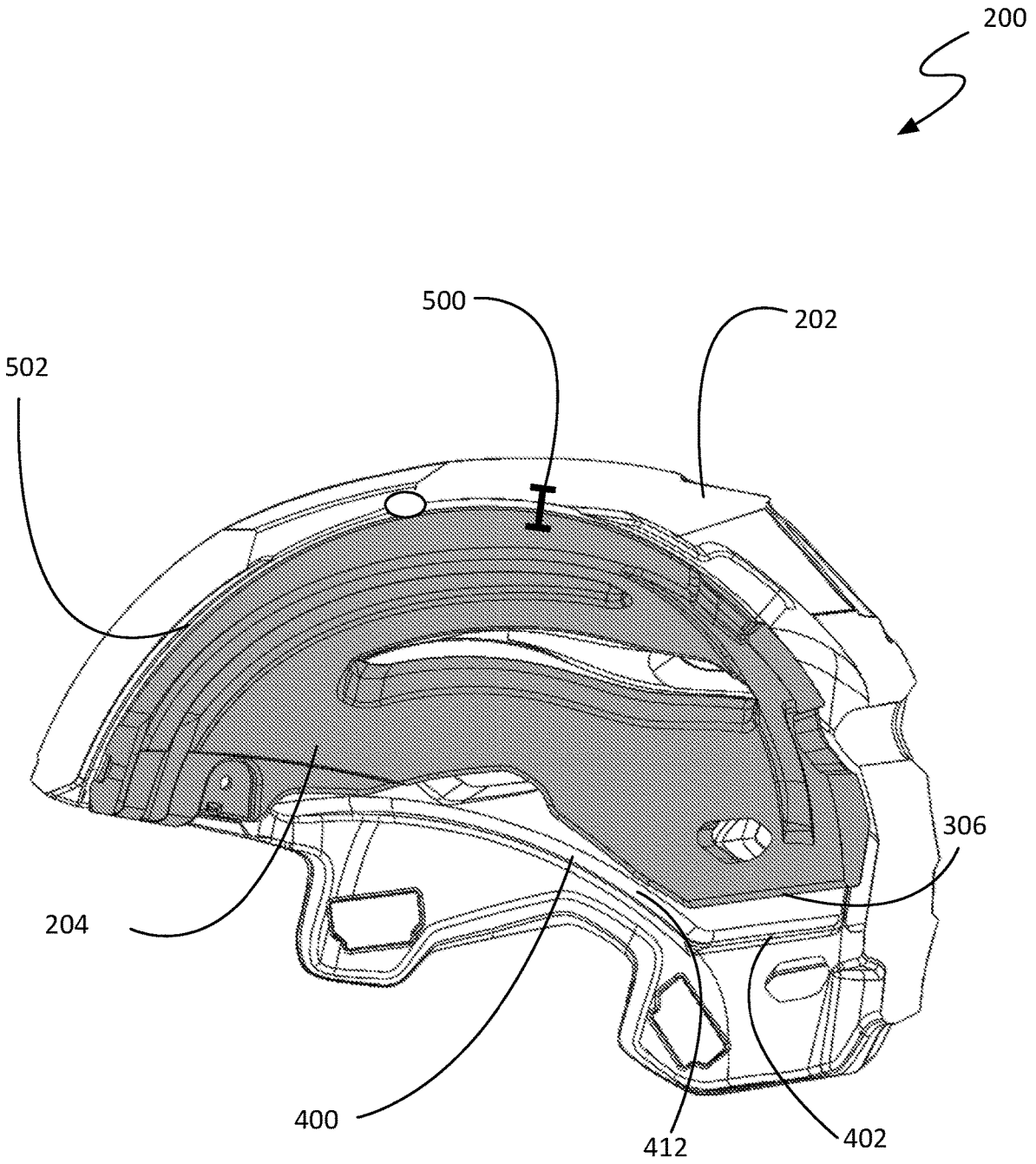
FIG. 5 is a side cross-sectional view of the helmet of FIG. 2 in the first position taken along cross-section lines B-B.

FIGS. 4A and 4B are cross-sectional views of the non-limiting example of the helmet 200 of FIG. 2, taken along the line A-A, while FIG. 5 is a cross-sectional view of the same non-limiting example, taken along the line B-B. As shown, the interior surface 300 of the outer liner 202 comprises a shelf 400 with an arresting surface 402, and the inner liner 204 comprises an edge 306 facing the arresting surface 402 of the shelf 400. The shelf 400 extends inward from the interior surface 300. In some embodiments, including the non-limiting example shown in FIGS. 4 and 5, the shelf 400 is proximate a perimeter 320 of the opening 206 of the outer liner 202. In other embodiments, the shelf 400 may be located on the interior surface 300 of the outer liner 202, away from the perimeter 320 (i.e. the inner liner 204 would be much smaller than the outer liner 202).

According to various embodiments, the shelf 400 serves to lock the inner liner 204 in place after it is placed inside the outer liner 202, and provides a hard stop to the motion, be it rotational or linear, of the inner liner 204 with respect to the outer liner 202. Other embodiments may include additional, or different, structures, surfaces, bumpers, and/or features to constrain the motion of the inner liner 204 relative to the outer liner 202 to desired bounds. In some embodiments, at some points the inner liner 204 may be fixed in place, while at others it may move freely.

Advantageous over conventional helmets, the use of a shelf 400 such as those described herein may be adapted to a variety of helmet types. For example, the non-limiting embodiment shown in FIGS. 2 through 5 is a bike helmet. These methods may be applied to any other helmet known in the art that may be used to protect against injuries due to rotational forces.

In some embodiments, the interior surface 300 of the outer liner 202 proximate a majority of the perimeter 320 of the opening 206 may comprise a shelf 400. In other words, a majority of the perimeter 320 may be proximate to a portion of the shelf 400. For example, the non-limiting example shown in FIGS. 4 and 5 depict a helmet 200 having a shelf 400 with a first portion 404 of the shelf 400 proximate the rear 312 of the outer liner 202, a second portion 406 proximate a side 314 of the outer liner 202, and a third portion 408 proximate the other side 314, opposite the second portion 406. In some embodiments, the helmet 200 may further comprise a portion of the shelf 400 proximate the front 310 of the outer liner 202. As shown, these portions are also all proximate the perimeter 320 of the opening 206 of the outer liner 202. Of course, in other embodiments, the shelf 400 may extend along less than a majority of the perimeter 320.

In some embodiments, the helmet 200 may comprise a plurality of partial shelves or shelf pieces 410. In some embodiments, a shelf piece 410 may be a portion of a shelf 400 (e.g. first portion 404 of FIG. 4A) directly attached to another portion (e.g. second portion 406 of FIG. 4A) such that together they form a single contiguous shelf 400. In other embodiments, a shelf piece 410 may be a portion of a shelf 400 that is distinct from other shelf pieces 410, each shelf piece having its own arresting surface 402.

As shown, the shelf 400, comprises an arresting surface 402 to interface with the edge 306 of the inner liner 204. As previously discussed, the edge 306 of the inner liner 204 faces the arresting surface 402 of the shelf 400. In the context of the present description and the claims that follow, the edge 306 of the inner liner 204 is considered to be facing the arresting surface 402 of the shelf 400 when the orientation of the edge 306 relative to the arresting surface 402 is such that when the inner liner 204 slides with respect to the outer liner 202 such that the inner liner 204 makes contact with the shelf 400, the edge 306, or a portion 418 of the edge 306, is in contact with the arresting surface 402, or a portion 420 of the arresting surface 402, of the shelf 400.

In some embodiments, the edge 306 and the arresting surface 402 may be shaped such that when they make contact, the edge 306 is mated with the arresting surface 402 where contact is made. In other embodiments, the arresting surface 402 may be shaped such that it captures, cups, wraps around, and/or retains the edge 306, such that the inner liner 204 is prevented from rotating out of the outer liner 202. In some embodiments, the arresting surface 402 of the shelf 400 may be a continuous surface. In other embodiments, the arresting surface 402 may be discontinuous. For example, the arresting surface 402 of a shelf 400 may be discontinuous when the shelf 400 comprises a plurality of shelf pieces 410, each separate and distinct from the others.

FIG. 4A shows a cross-sectional view of a non-limiting example of helmet 200 with an inner liner 204 in a centered or first position 414. In the context of the present description and the claims that follow, the centered or first position 414 refers to the ideal or neutral position of the inner liner 204 inside of the outer liner 202. According to various embodiments, including the non-limiting example shown in FIGS. 4 and 5, when the inner liner 204 is in the first position 414, the edge 306 of the inner liner 204 is separated from the arresting surface 402 which it faces by a first gap 412. In some embodiments, the first gap 412 may be between 12 mm and 15 mm. In other embodiments, the first gap 412 may be larger, while in still others it may be smaller.

In some embodiments, the first gap 412 between the arresting surface 402 and the edge 306 may be substantially uniform. In the context of the present description and the claims that follow, substantially uniform refers to the size of the first gap 412 being within a particular distance range throughout the arresting surface 402. For example, the difference between the smallest first gap 412 and the largest first gap 412 throughout the arresting surface 402 may be 1 mm, 2 mm, 3 mm, or more. In other embodiments, the first gap 412 between the arresting surface 402 and the edge 306 may be non-uniform. As a specific example, the first gap 412 between the edge 306 and the arresting surface 402 may widen to make space for a ventilation duct through the inner liner 204 and the outer liner 202.

The inner liner 204 is slidably movable between the first position 414 and an arrested position 416, in which the edge 306, or a portion of the edge 306, of the inner liner 204 is in contact with the arresting surface 402, or a portion of the arresting surface 402, of the shelf 400. FIG. 4A shows a cross-sectional view of a non-limiting example of helmet 200 with an inner liner 204 in an arrested position 416. It is worth noting that all discussion of motion, rotational and/or linear, of one of the liners is relative with respect to the other liner. For example, any discussion of motion of the inner liner 204 with respect to the outer liner 202 could be reframed as motion of the outer liner 202 with respect to the inner liner 204.

In some embodiments, forces may be needed to return the inner liner 204 to a pre-impact position (e.g. first position 414). See, for examples, the return spring 500 of FIG. 5. According to various embodiments, the inner liner 204 may be directly coupled to the interior surface 300 of the outer liner 202 through at least one return spring 500, which returns the inner liner 204 back to a first position 414. The return springs 500 may also serve to attenuate some of the rotational energy from an impact.

A return spring 500 may be composed of a variety of elastic materials, including but not limited to an elastomer such as silicone. According to various embodiments, a return spring 500 may have a variety of shapes, including but not limited to bands, cords, and coils. In some embodiments, one or more return springs 500 may directly couple an edge 306 of the inner liner 204 to the interior surface 300 of the outer liner 202. In other embodiments, one or more return springs 500 may directly couple the outer liner 202 to locations on the exterior surface 302 of the inner liner 204 that are not proximate an edge 306 of the inner liner 204.

Some embodiments may employ one or more return springs 500 to return the inner liner 204 to the first position 414. Other embodiments may employ additional, or alternative methods. For example, in some embodiments, the first gap 412 between the edge 306 and the arresting surface 402 may be empty. In other embodiments, the first gap 412 may contain a bumper composed of an elastic material, which may serve to absorb impact energy and return the inner liner 204 to the first position 414. In some embodiments the shelf 400 may be integral to the outer liner 202, and may be composed of the same material as the rest of the outer liner 202. In other embodiments, the shelf 400 may be composed of an elastic material that may absorb additional impact energy transferred through motion of the inner liner 204 and assist in returning the inner liner 204 to the first position 414.

As shown in FIG. 3, the outer liner 202 comprises a plurality of vents 316 that pass through the outer liner 202, and the inner liner 204 comprises a plurality of channels 318 that pass through the inner liner 204. As shown in FIGS. 4 and 5, the plurality of vents 316 at least partially overlap with the plurality of channels 318 to form a plurality of apertures 422 from outside the helmet to inside the helmet. According to various embodiments, the exterior surface 302 of the inner liner 204 and the interior surface 300 of the outer liner 202 may not be continuous, and may comprise vents, channels, openings, and/or other features which introduce voids in the surfaces. In some embodiments, including the non-limiting example shown in FIGS. 2 through 5, such voids may provide fluid communication between outside the helmet and a user's head, improving ventilation while the helmet is in use. In other embodiments, such voids may be employed to reduce the overall weight of a helmet. In still other embodiments, such voids may be employed for other reasons. While the following discussion will be in the context of vents 316 and channels 318, it should be recognized that the methods and structures described may be applied to any other void in a rotation surface (e.g. exterior surface 302 of the inner liner 204, interior surface 300 of the outer liner 202, etc.).

While use of vents 316, channels 318, and/or apertures 422 in helmets is well known in the art, an inner liner 204 slidably coupled to the inside of an outer liner 202 through return springs 500 presents an issue not faced by conventional helmets. Therefore, according to various embodiments, the edges (i.e. the boundary where the liner surface tips inward to start a void in the surface) of vents 316 are shaped at the interior surface 300 and the edges of channels 318 are shaped at the exterior surface 302 such that rotation of the outer liner 202 with respect to the inner liner 204 is not impeded (e.g. the edge of a vent getting caught on the edge of a channel, etc.).

In some embodiments, including the non-limiting example shown in FIGS. 2-5, the vents 316 are beveled at the interior surface 300 of the outer liner 202, and the channels are beveled at the exterior surface 302 of the inner liner 204. In the context of the present description and the claims that follow, beveled means having a sloping edge. Examples of a sloping edge include but are not limited to one or more angled planes, and a curved surface. Thus, a vent 304 beveled at the interior surface 300 would, at least initially, narrow as it extends through the outer liner 202.

As noted above, attenuation of rotational energy occurs when the exterior surface 302 of the inner liner 204 and the interior surface 300 of the outer liner 202 rotate against each other. In various embodiments, one or more of these surfaces may be modified to facilitate that rotation. For example, in one embodiment, the exterior surface 302 of the inner liner 204 may comprise a surface of reduced friction 322, having been treated with a material to decrease friction. Materials include, but are not limited to, in-molded polycarbonate (PC), an in-molded polypropylene (PP) sheet, and/or fabric LFL. In other embodiments, a material or a viscous substance may be sandwiched between the two liners to facilitate rotation.

According to one embodiment, there may be an air gap 502 between the two liners, or between a majority of the exterior surface 302 of the inner liner 204 and the interior surface 300 of the outer liner 202, to help allow for movement. For example, the air gap 502 between the two liners may range from 0.3 mm to 0.7 mm. In other embodiments, there may be other distances of air gap 502 between the two liners.

Where the above examples, embodiments and implementations reference examples, it should be understood by those of ordinary skill in the art that other helmet and manufacturing devices and examples could be intermixed or substituted with those provided. In places where the description above refers to particular embodiments of helmets and customization methods, it should be readily apparent that a number of modifications may be made without departing from the spirit thereof and that these embodiments and implementations may be applied to other to helmet customization technologies as well. Accordingly, the disclosed subject matter is intended to embrace all such alterations, modifications and variations that fall within the spirit and scope of the disclosure and the knowledge of one of ordinary skill in the art.

What is claimed is:

1. A helmet comprising:

an outer liner having an interior surface comprising a shelf extending inward from the interior surface of the outer liner proximate a perimeter of an opening at a lower edge of the outer liner, the shelf comprising an arresting surface; and an inner liner having an exterior surface, an interior surface and an edge connecting the exterior surface of the inner liner to the interior surface of the inner liner, the edge facing the arresting surf ace of the shelf;

wherein the inner liner is slidably coupled to the interior surface of the outer liner and slidably movable relative to the outer liner between a first position in which the edge of the inner liner is separated from the arresting surface of the shelf by a first gap, and an arrested position in which a portion of the edge of the inner liner is in contact with a portion of the arresting surface of the shelf in response to movement of the outer liner relative to the inner liner caused by an impact to the helmet, wherein at least one of the outer liner and the inner liner comprise an energy management material;

further comprising at least one return spring coupling the outer liner with the inner liner and biasing the inner liner toward the first position from the arrested position after the inner liner moves from the first position to the arrested position in response to the impact to the helmet, wherein the at least one return spring is composed of an elastomer material.

2. The helmet of claim 1, wherein the energy management material comprises at least one of expanded polystyrene (EPS), expanded polyurethane (EPU), expanded polyolefin (EPO), and expanded polypropylene (EPP).

3. The helmet of claim 1, wherein the interior surface of the outer liner proximate a majority of the perimeter of the opening includes the shelf.

4. The helmet of claim 1, wherein the shelf further comprises a material having a different elasticity from a material of a portion of the outer liner.

5. The helmet of claim 1, wherein the shelf comprises a plurality of shelf pieces, and at least two of the plurality of shelf pieces are separate and distinct from each other.

6. The helmet of claim 1, wherein the outer liner further comprises a front, a rear, and two sides opposite each other and connecting the front and the rear, and wherein a first portion of the shelf is located proximate the rear of the outer liner, a second portion of the shelf is located proximate one of the two sides of the outer liner, and a third portion of the shelf is located proximate the other of the two sides of the outer liner.

7. The helmet of claim 1, wherein the first gap is substantially uniform across the arresting surface when the inner liner is in the first position.

8. The helmet of claim 1:

wherein the outer liner comprises a plurality of vents passing through the outer liner;

wherein the inner liner comprises a plurality of channels passing through the inner liner; and wherein the plurality of channels at least partially overlap with the plurality of vents to form a plurality of apertures from outside the helmet to inside the helmet.

9. The helmet of claim 8:

wherein each of the plurality of vents is beveled at the interior surface of the outer liner; and wherein each of the plurality of channels is beveled at the exterior surface of the inner liner.

10. The helmet of claim 1, wherein at least one of the interior surface of the outer liner and the exterior surface of the inner liner comprises a surface treated with a friction-reducing material comprising in-molded polycarbonate (PC) or in-molded polypropylene (PP).

11. The helmet of claim 1, wherein an air gap exists between a majority of the exterior surface of the inner liner and the interior surface of the outer liner.

* * * * *